US005324705A

United States Patent [19]

Ito

[11] Patent Number: 5,324,705

[45] Date of Patent: Jun. 28, 1994

[54] PRINTING SHEET COMPRISING AN IMAGE-RECEIVING LAYER MADE OF AN ACIDIC RESIN

[75] Inventor: Kengo Ito, Kanagawa, Japan

[73] Assignee: Sony Corporation, Tokyo, Japan

[21] Appl. No.: 900,269

[22] Filed: Jun. 18, 1992

[30] Foreign Application Priority Data

Jun. 18, 1991 [JP] Japan ..... 3-146013

[51] Int. Cl.[5] ..... B41M 5/035; B41M 5/38

[52] U.S. Cl. ..... 503/227; 428/195; 428/500; 428/518; 428/913; 428/914

[58] Field of Search ..... 8/471; 428/195, 500, 428/518, 913, 914; 503/227

[56] References Cited

U.S. PATENT DOCUMENTS 5,112,799 5/1992 Egashira et al. ..... 503/227

*Primary Examiner*—B. Hamilton Hess

*Attorney, Agent, or Firm*—Hill, Steadman & Simpson

[57] ABSTRACT

A printing sheet which is used in combination with an ink ribbon containing a hydrophobic cationic dye is described. The printing sheet comprises on a support an image-accepting layer made of an acidic resin or resin composition whereby the transfer sensitivity and storage stability of the resultant image are significantly improved.

3 Claims, 3 Drawing Sheets

PRINTING SHEET COMPRISING AN IMAGE-RECEIVING LAYER MADE OF AN ACIDIC RESIN

BACKGROUND OF THE INVENTION

1. Field of the Invention

This invention relates to a printing sheet which is suitable for use in full color hard copies of video printers.

2. Description of the Prior Art

In Japanese Patent Application No. 3-10204, we proposed hydrophobic cationic dyes for an ink ribbon of thermal transfer systems which are adapted for use as a full color hard copying material of video printers and also the ink ribbon using the hydrophobic cationic dyes. The citation is incorporated herein by reference.

SUMMARY OF THE INVENTION

It is an object of the invention to provide a printing sheet which is adapted for use in combination with an ink ribbon containing a hydrophobic cationic dye of the type mentioned above and which comprises an image-accepting layer made of an acidic resin whereby when the printing sheet is applied as a printing paper for hard copying from video printers, the thermal transfer sensitivity becomes high while significantly suppressing migration of the dye after formation of an intended image.

It is another object of the invention to provide a printing sheet which ensures high sensitivity and a long image life when used in combination with an ink ribbon containing a hydrophobic cationic dye.

The above objects can be achieved, according to the invention, by a printing sheet of the type which is used in combination with an ink ribbon containing a hydrophobic cationic dye in a thermal transfer system, the printing sheet comprising on a support an image-accepting layer which is made of an acidic resin or a resin having an acidic low molecular weight compound in miscibility with the resin.

Preferably, the image-accepting layer is made of a vinylidene chloride/acrylonitrile copolymer.

The combination of the image-accepting layer and an ink ribbon containing a hydrophobic cationic dye enables one to obtain a printing sheet which has high sensitivity and good image life as will not be expected in prior art counterparts. More particularly, when an ink ribbon containing a hydrophobic dye layer is superposed on a printing sheet of the invention having an acidic resin image-accepting layer according to a known procedure and subjected to thermal transfer in an imagewise manner, the transfer sensitivity is very good and the resultant image has good storage stability and is fixedly secured over a long term.

DETAILED DESCRIPTION AND EMBODIMENTS OF THE INVENTION

Figure 1:
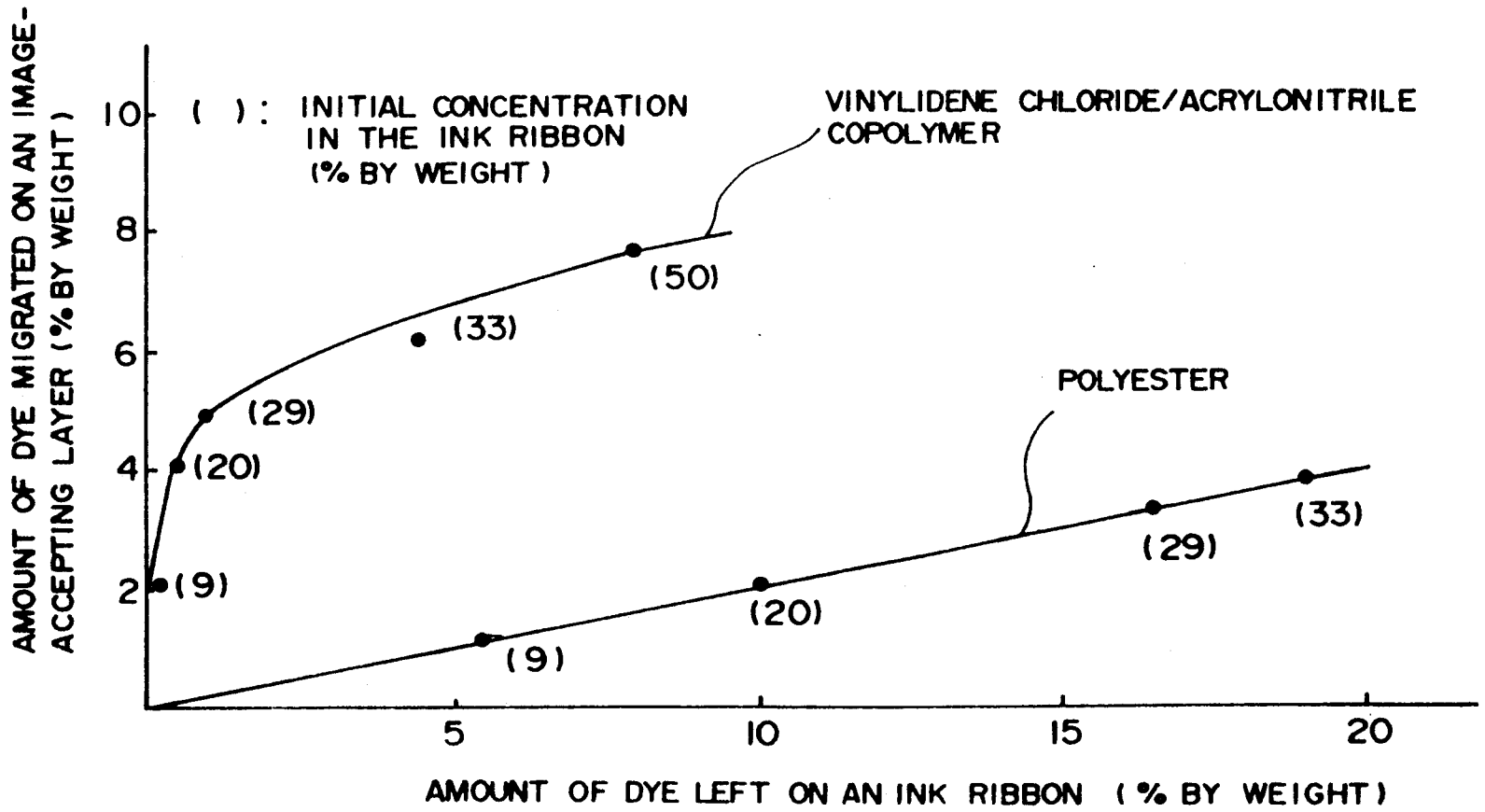
FIG. 1 is a graph showing the amount of a dye migrated on an image-accepting layer in relation to the variation in the amount of the dye left on an ink ribbon for different types of resins used as an image-accepting layer.

The invention is characterized by an image-accepting layer of a printing sheet used in combination with the ink ribbon of the type set out hereinabove, which accepting layer being made of an acidic resin or a resin having an acidic low molecular weight compound in miscibility or compatibility with the resin.

The acidic resins useful in the present invention include vinylidene chloride/acrylonitrile copolymers, carboxylated vinyl chloride polymers, and the like. The resins having an acidic low molecular weight compound are copolymers of vinyl chloride and monomers having an acidic group, those polymers which are obtained by polymerization in the presence of a catalyst for polymerization having acidic groups, and the like.

More particularly, resins called an acidic resin may be those resins which exhibit electron acceptability against electron donative cationic dyes. In other words, the acidic resins are a general term for polymers which have electron acceptive substituents, such as active proton, in the molecule. Accordingly, there may be used, as an acidic resin, resins which have an acidic group such as a sulfone group, a carboxyl group or the like in the main or side chains thereof on assumption from the molecular structure. Thus, useful acidic resins of the invention are not limited to those mentioned above, but all resins which exhibit acidity when determined by a procedure set out hereinafter may also be used in the practice of the invention. In an extreme case, resins which have an acid residue, such as of potassium persulfate used as a catalyst for polymerization, at terminal ends of the molecule may be used. Specific examples of the above type of resin include acrylic fibers.

From the practical standpoint as to how to determine acidic resins (which are limited to oleophilic resins because good miscibility with hydrophobic cationic dyes is favorably expected), we have adopted a determination procedure which makes use of an oleophilic leuco dye which is able to develop a color on molecular contact with an acid. More particularly, the determination is made whether or not a solution of a fluoran color former (dye precursor) or a film prepared from the solution is colored on contact with a non-aqueous solution of an intended resin. It has been found that when a number of resins are pre-tested by the above procedure, a vinylidene cholride/acrylonitrile copolymer (reagent made by aldrich Inc.) and corboxylated vinyl chloride polymer (reagent made by Aldrich Inc.) exhibit high acidity. In fact, these copolymer and polymer are preferable when used in combination with the ribbon of the type set forth hereinbefore.

The present invention is more particularly described by way of examples.

EXAMPLE 1

A solution containing a vinylidene chloride/acrylonitrile copolymer (hereinafter referred to simply as PVCL-AN) at the following ratio by weight was prepared and provided as a coating solution.

| Coating solution | Parts by weight |
|---|---|
| PVCL-AN | 1 |

-continued

| Coating solution | Parts by weight |
|---|---|
| MEK | 10 |

The coating solution was applied onto a 180 micrometer thick synthetic paper sheet by the use of a doctor blade and dried at 60° C. for 30 minutes under reduced pressure. As a result, there was obtained a printing sheet which had an image-accepting layer having a dry thickness of about 5 micrometers and consisted of PVCL-An.

A dye used in combination with the printing sheet was prepared in the following manner.

3 g of an oxazine cationic dye (commercial name: AIZEN Cathilon Pure Blue 5GH, available from Hodogaya Chemical Co., Ltd.) was dissolved in 200 cc of water, in which an aqueous solution of 20 wt % of a dodecylbenzenesulfonate was dropped. The ion exchange with the anionic surface active agent took place to precipitate a large amount of fine crystals with a metallic luster.

300 cc of chloroform was added to the mixed solution containing the fine crystals, followed by extraction by the use of a separating funnel whereupon the dye was transferred to the chloroform phase.

When the cationic dye which had not been subjected to ion exchange treatment with any anionic surface active agent was similarly subjected to the extraction, most of the dye was left in the aqueous phase. From this, it will be appreciated that the solubility or hydrophobicity of the dye with the organic solvent was drastically enhanced by the ion exchange treatment.

After the ion exchange treatment, the organic chloroform phase was collected and the solvent was distilled off under reduced pressure, followed by drying at 50° C. under reduced pressure to obtain about 4 g of a solid matter. The resultant dye had a melting point of 80° C., which is lower by 40° C. than of the starting dye.

The dye obtained above was dissolved in a mixed solvent of MEK and toluene capable of dissolving polyvinyl butyral (commercial name: PVB 300K, available from Sekisui Chem. Co., Ltd.) used as a binder polymer to obtain a coating solution. The composition of the mixed solution in which the dye was to be dissolved had the following formulation.

| | Part by weight |
|---|---|
| Polyvinyl butyral | 1 |
| MEK/toluene (1/1 by weight) | 50 |

The dye was dissolved in an amount of from 9 to 50 wt %.

The solution was applied onto a polyethylene terephthalate (PETP) by the use of a wire bar and dried at room temperature, followed by during in an oven at a temperature of 120° C. for 2 minutes. Thus, there was obtained a ribbon having a 1 micrometer thick coloring layer on the PETP film.

The ink ribbons which contained from 9 to 50 wt % of the cyan-colored hydrophobic cationic dye prepared above were subjected to thermal transfer on the printing sheet by a static color developing process. The thermal press time used was a time before the amount of thermal transfer or migration of the dye reached a saturation. Under color-developing conditions of 100° C. and 200 g/cm$^2$, the time was about one minute.

For the evaluation, the following test was performed.

After the thermal transfer, the amount of the dye left on the ink ribbon and the amount of the dye migrated on the image accepting layer were determined from an optical density or transmittance of the ribbon. The results are plotted as a so-called adsorption isotherm as shown in FIG. 1. In FIG. 1, there are also shown the results of a printing sheet (Sony Co., Ltd.) having an image accepting layer made of a polyester resin, which was similarly subjected to thermal transfer for comparison.

From FIG. 1, it will be seen that the hydrophobic cationic dye has very great affinity for the PVCL-AN in an amount of not less than about 30 wt % in the ink ribbon and is strongly adsorbed. In contrast, the dye exhibits relatively weak affinity for the polyester resin which has not acidic group.

EXAMPLE 2

The results of FIG. 1 were evaluated as intended practical characteristics, e.g. the relation between the sensitivity and the storage stability.

Figure 2:
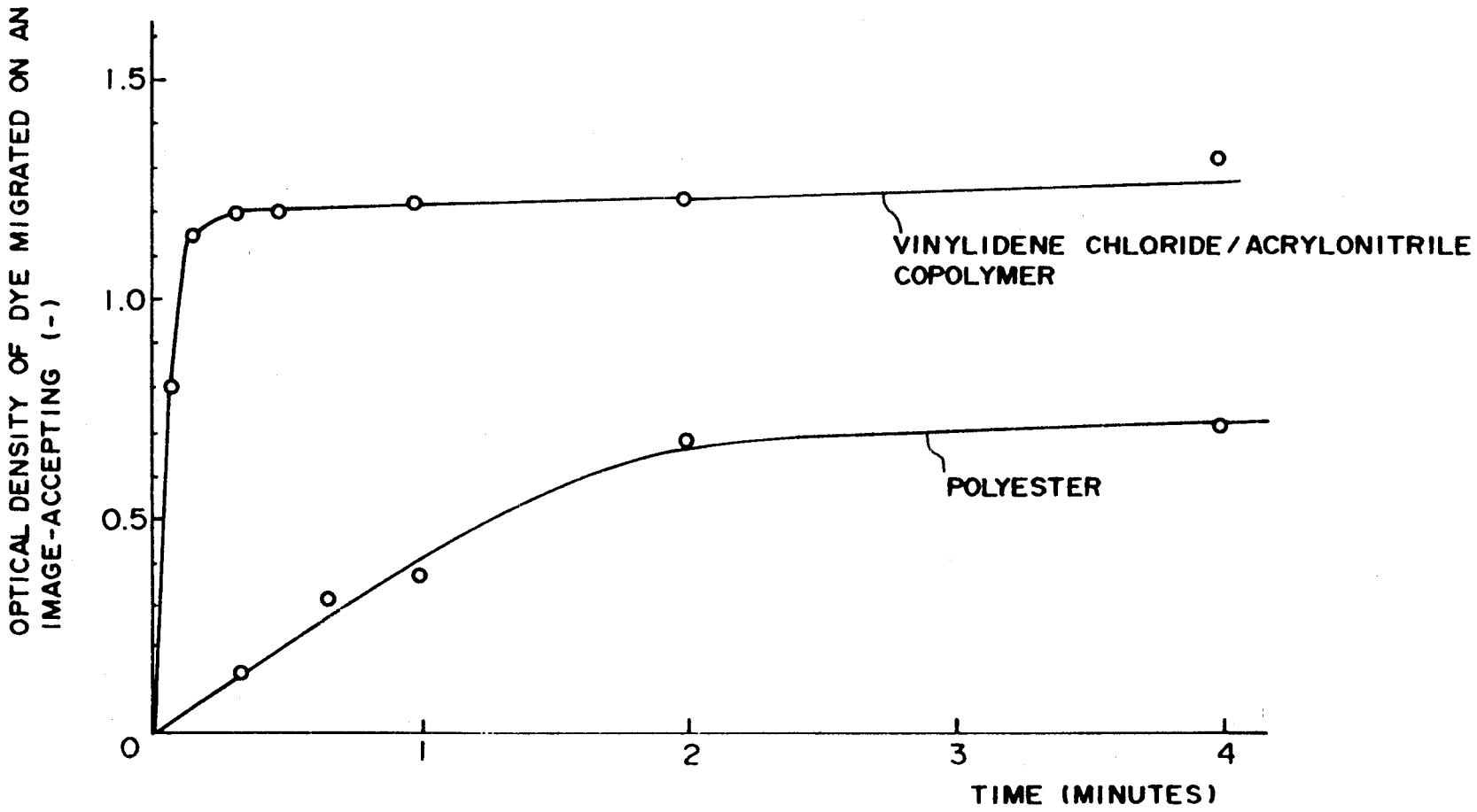
FIG. 2 is a graph showing an optical density of the dye migrated on the image-accepting layer in relation to the variation in the thermal transfer time for different types of resins used in the image accepting layer.

The ink ribbon obtained in Example 1 (containing 50 wt % of the hydrophobic cationic dye and polyvinyl butyral) was used to check the amount of a migrated dye in relation to the variation in time when it was subjected to thermal transfer to the PVCL-AN printing sheet and the polyester printing sheet under the same color-developing conditions as used in Example 1 (100° C., 200 g/m$^2$). The results are shown in FIG. 2, revealing that the thermal transfer (thermal migration) takes place on the PVCL-AN image-accepting layer having the great affinity at a rate of about ten times that on the polyester image-accepting layer. This means an increase of the thermal sensitivity.

EXAMPLE 3

A printing sheet was fabricated from a coating solution, in which polyvinyl butyral was dissolved at the following ratio by weight, in the same manner as in Example 1.

| Coating solution | Parts by weight |
|---|---|
| Polyvinyl butyral | 1 |
| Toluene/MEK (1/1 by weight) | 10 |

In the same manner as in Example 1, ribbons were fabricated using, as a binder resin, PVCL-AN and a polyester resin. For the PVCL-AN, a mixed solvent of toluene and MEK (1/1000 by weight) was used as a solvent.

Figure 3:
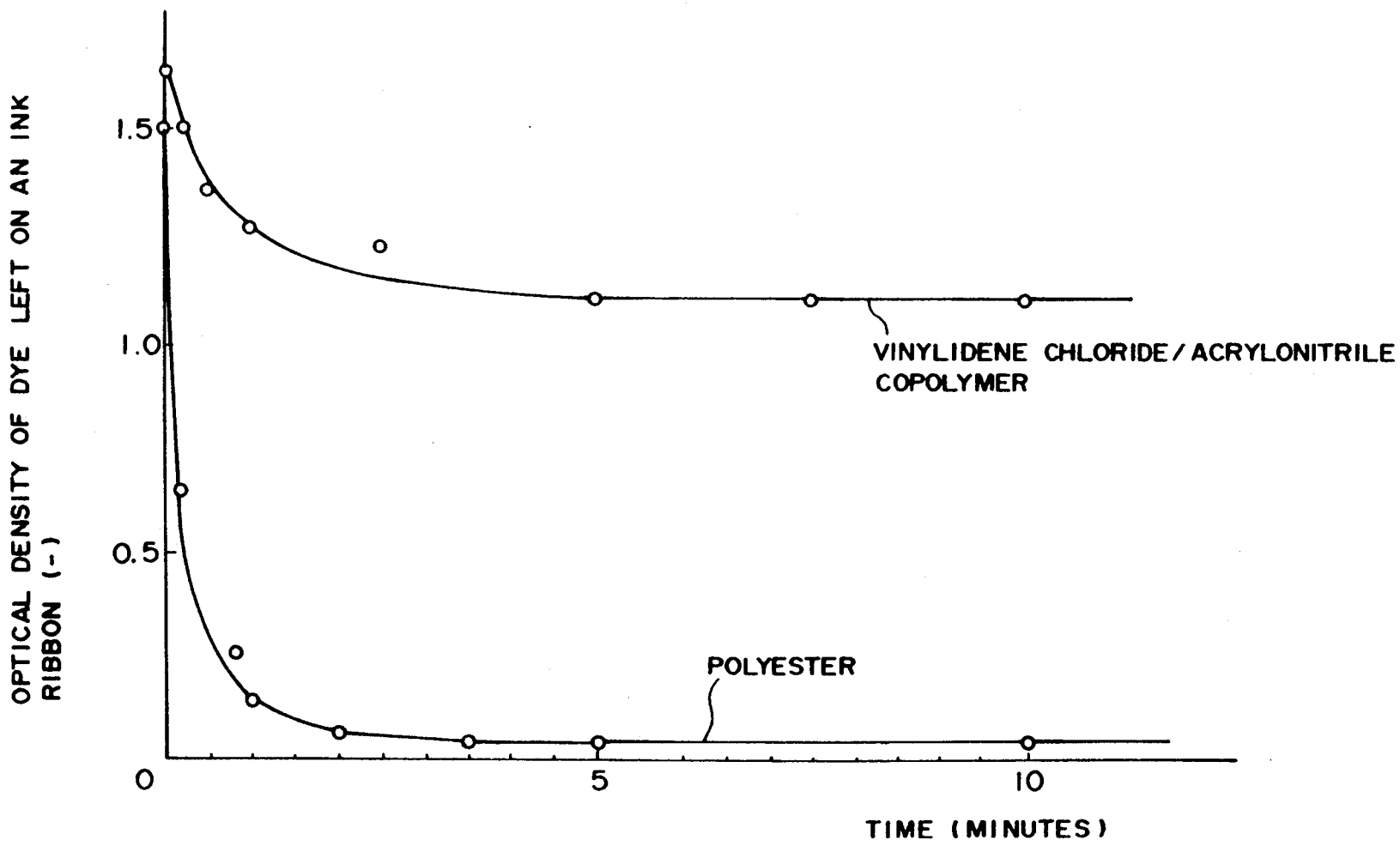
FIG. 3 is a graph showing optical density of the dye left on the ink ribbon in relation to the variation in the thermal transfer time for different types of resins used in the ribbon.

These ink ribbons and the printing sheet were, respectively, used to effect the thermal transfer test in the same manner as in Example 2. The results are shown in FIG. 3. From FIG. 3, it will be seen that substantially all amount of the dye is readily migrated from the resin having a smaller affinity for the dye on the accepting resin layer. On the other hand, with the resin having a greater affinity for the dye, a similar migration is unlikely to occur and about 70% of the dye in the dye layer is reliably maintained or fixed.

These results mean that the storage stability of the image after formation thereof is drastically improved.

From the examples, the combination of the the ink ribbon using hydrophobic cationic dyes and the image-accepting layer made of an acidic resin can develop high sensitivity and high fixing properties as will not be achieved in prior art.

What is claimed is:

1. A printing system, comprising:

an ink donor sheet; and a printing sheet comprising on a support an image-accepting layer which is made of an acidic resin or a resin dissolved with an acidic low molecular weight compound, wherein the acidic resin is a vinylidene chloride/acrylonitrile copolymer or a carboxylated vinyl chloride polymer.

2. A printing system, comprising:

an ink ribbon containing a hydrophobic cationic dye; and a printing sheet comprising on a support an image-accepting layer which is made of an acidic resin or a resin dissolved with an acidic low molecular weight compound, wherein the acidic resin is a vinylidene chloride/acrylonitrile copolymer or a carboxylated vinyl chloride polymer.

3. A process of thermal imaging, comprising the steps of:

providing an image-accepting layer on a support to form a printing sheet, the image-accepting layer being made of an acidic resin or a resin dissolved with an acidic low molecular weight compound, wherein the acidic resin is a vinylidene chloride/acrylonitrile copolymer or a carboxylated vinyl chloride polymer;

providing an ink ribbon containing a hydrophobic cationic dye;

contacting the image-accepting layer of the printing sheet with the hydrophobic cationic dye of the ink ribbon; and heat transferring the hydrophobic cationic dye of the ink ribbon to the image-accepting layer of the printing sheet.

* * * * *